United States Patent [19]

Cochran

[11] Patent Number: 4,898,552

[45] Date of Patent: Feb. 6, 1990

[54] OUTDRIVE LOWER UNIT HOUSING-TO-PROPELLER HUB BRIDGING SLEEVE

[75] Inventor: Ivan L. Cochran, Immokalee, Fla.

[73] Assignees: Edward R. Olesky, Immokalee; Fred Tittle, Tavernier, both of Fla. ; a part interest to each

[21] Appl. No.: 260,271

[22] Filed: Oct. 20, 1988

[51] Int. Cl.[4] ..... B63H 5/16

[52] U.S. Cl. ..... 440/71; 416/247 A; 440/73

[58] Field of Search ..... 440/6, 71–73, 440/78; 416/247 A; 156/158; 114/88

[56] References Cited

U.S. PATENT DOCUMENTS

| | | | |
|---|---|---|---|
| 4,013,033 | 3/1977 | Porter et al. | 440/72 |
| 4,555,233 | 11/1985 | Klammer et al. | 440/6 X |
| 4,722,667 | 2/1988 | Rikhy et al. | 416/247 A |
| 4,777,898 | 10/1988 | Faulkner | 114/88 |

FOREIGN PATENT DOCUMENTS

| | | | |
|---|---|---|---|
| 522862 | 6/1940 | United Kingdom | 440/73 |

*Primary Examiner*—Sherman D. Basinger

*Attorney, Agent, or Firm*—Fleit, Jacobson, Cohn, Price, Holman & Stern

[57] ABSTRACT

A thin wall sleeve is provided including an inside diameter greater than the outside diameter of the rear terminal end of a marine outdrive lower unit propeller drive housing portion and the adjacent front terminal end of an associated marine propeller hub. The sleeve is mounted in position with its opposite ends telescoped over the housing portion and hub terminal ends and the longitudinal mid-portion of the sleeve bridging the axial spacing therebetween. The sleeve is mounted from the housing portion terminal end, for example, by an adhesive band layer, maintaining the inside diameter surfaces of the sleeve radially spaced outward of the outer surfaces of the housing portion rear terminal end and the hub front terminal end loosely rotatably received within the sleeve.

4 Claims, 1 Drawing Sheet

OUTDRIVE LOWER UNIT HOUSING-TO-PROPELLER HUB BRIDGING SLEEVE

BACKGROUND OF THE INVENTION

1. Field of the Invention

Marine outdrive assemblies including inboard/outboard drives, gasoline powered outboard motors and electric trolling motors, etc. include lower units incorporating horizontally elongated and front-to-rear extending housing portions having front and rear ends. The rear ends of the housing portions include at least substantially cylindrical terminal ends centrally from which the rear ends of propeller shafts project upon which marine propellers are removably mounted. The marine propellers include hub portions whose forward ends are substantially cylindrical and of substantially the same diameter as the aforementioned rear terminal ends of the housing portions. The propeller hubs usually are spaced slightly rearward of the lower unit housing portion rear terminal ends and it is possible for foreign material such as seaweed strands, fishing lines, steel fishing leaders and other small diameter lines to pass through the spacing between the rear terminal ends of, the lower unit housing portions and the forward ends of the associated propeller hubs.

The instant invention resides in the provision of a cylindrical sleeve having front and rear ends telescoped over the rear terminal end of an outdrive lower unit housing portion and the opposing forward end of an associated propeller hub with the sleeve front end stationarily mounted from the lower unit housing portion rear terminal end and the rear end of the sleeve closely rotatably receiving the front end of the associated propeller hub therein.

2. Description of Related Art

Various different forms of lower unit weed guards and fish line cutters including some of the general structural and operational features of the instant invention heretofore have been provided. In -addition, projective casings for the lower units of an outboard drives also have been heretofore designed.

An example of a lower unit protective casing is disclosed in U.S. Pat. No. 3,939,795 and examples of weed guards for outboard drives are disclosed in U.S. Pat. Nos. 3,802,377, 3,859,953, 4,013,033 and 4,070,984 while U.S. Pat. No. 4,609,361 discloses a fish line cutter.

However, all of the above-mentioned prior patents utilize relatively large and expensive structures for accomplishing their intended function and the instant invention utilizes only a simple sleeve member in addition to mounting means therefor. Further, the sleeve member of, the instant invention may be used in conjunction with substantially all outdrive units and may be manufactured in different sizes for use on substantially any outdrive unit.

Further, the sleeve of the instant invention may be constructed of various different materials including metals and plastics, and if a plastic is used in the construction of the sleeve with adhesive means used to mount the sleeve on an associated outdrive lower unit housing portion and it subsequently becomes necessary to remove the sleeve, the sleeve may be readily cut from the out drive lower unit housing portion and inexpensively replaced.

SUMMARY OF THE INVENTION

The protective sleeve of the instant invention may comprise a thin wall sleeve member constructed of either metal or plastic and may be produced in various different forms. The sleeve may be constructed of spring metal and longitudinally split in order to enable the sleeve to be slightly spread apart and slipped over the outer surface of the rear terminal end of a lower unit housing portion having a coating of adhesive applied over the outer cylindrical surface of the rear terminal end thereof. In this manner, the inside diameter of the sleeve may be maintained slightly greater than the outside diameter of the rear terminal end of the associated housing portion and thus the outside diameter of the forward end of the associated propeller hub over which the rear end of the sleeve is loosely telescoped.

The sleeve also may be made of plastic and adhesively secured, in place or, peripherally continuous and made of metal and adhesively secured in place.

The adhesive means for securing the sleeve in place may include a strip of tape secured about the rear terminal end of the associated lower unit housing portion and over which the forward end of the sleeve is telescoped and secured by adhesive means. In this manner, the rear end of the sleeve will have the inner surfaces thereof radially spaced outward from the outer surfaces of the forward end of the associated propeller hub.

The main object of this invention is to provide a structure and method for preventing the entrance of foreign materials between the rear terminal end of a lower unit housing portion and the opposing forward end of an associated propeller hub, the propeller shaft upon which the propeller hub is mounted including seal means operatively associated therewith supported from the lower unit housing portion to prevent the entrance of water into the lower unit housing portion. Such seal means may be damaged by foreign materials entering the axial spacing between the rear terminal end of the lower unit housing portion and the opposing propeller hub front end.

Another object of this invention is to provide a sleeve member in accordance with the preceding objects and which may be constructed of metal or plastics.

Still another important object of this invention is to provide an apparatus in accordance with the preceding objects and which may be readily, constructed of different sizes and lengths so as to, be adaptable to use in conjunction with substantially all outdrive lower unit housing portions and associated marine propellers.

A final object of this invention to be more specifically enumerated herein is to provide a device in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
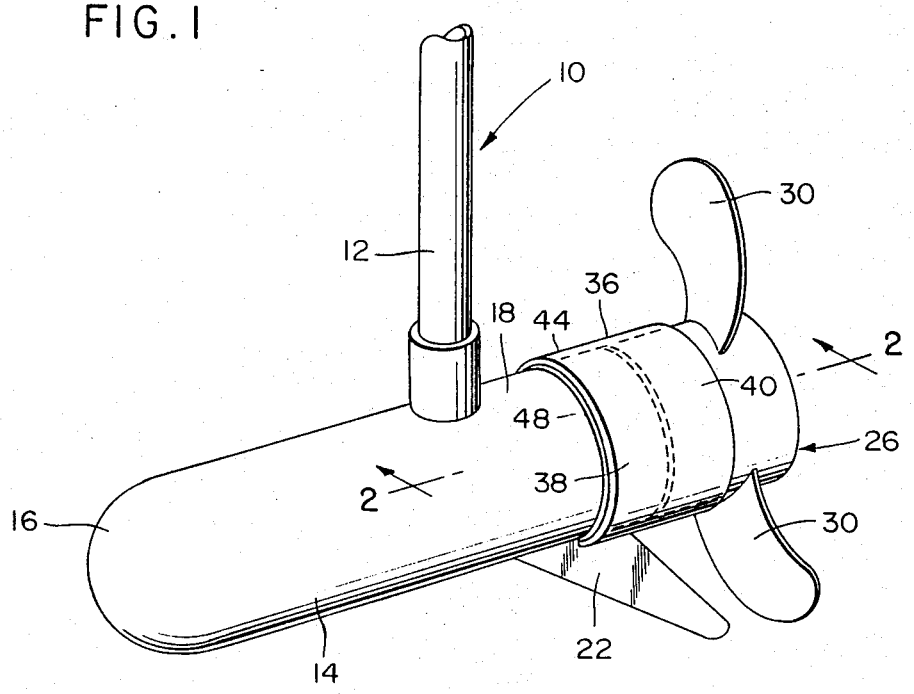
FIG. 1 is a fragmentary, perspective view of the lower unit assembly of an electric trolling motor upon which a protective sleeve has been mounted in accordance with the present invention.

Referring now more specifically to the drawings, the numeral 10 generally designates a typical electric trolling motor including a depending shaft portion 12 mounting a horizontally elongated housing portion 14 on its lower end including front and rear ends 16 and 18. The housing portion 14 encloses an electric motor (the control for which being mounted from the upper end of the shaft portion 12 and not illustrated) and the electric motor includes a main shaft having one end 20 projecting centrally out of the rear end 18 of the housing portion 14. The rear end 18 includes depending skeg 22 and a terminal end 24 projecting rearwardly of the skeg 22 and which is substantially cylindrical.

A propeller referred to in general by the reference numeral 26 is mounted upon the one end 20 of the motor shaft and the propeller includes a hub portion 28 mounted upon the end 20 and blades 30 projecting generally radially outward of the hub portion 28. The hub portion 28 includes a forward end 32 adjacent, but spaced rearward of, the terminal end 24 and a rear end 34 from which the blades 30 are supported.

Figure 2:
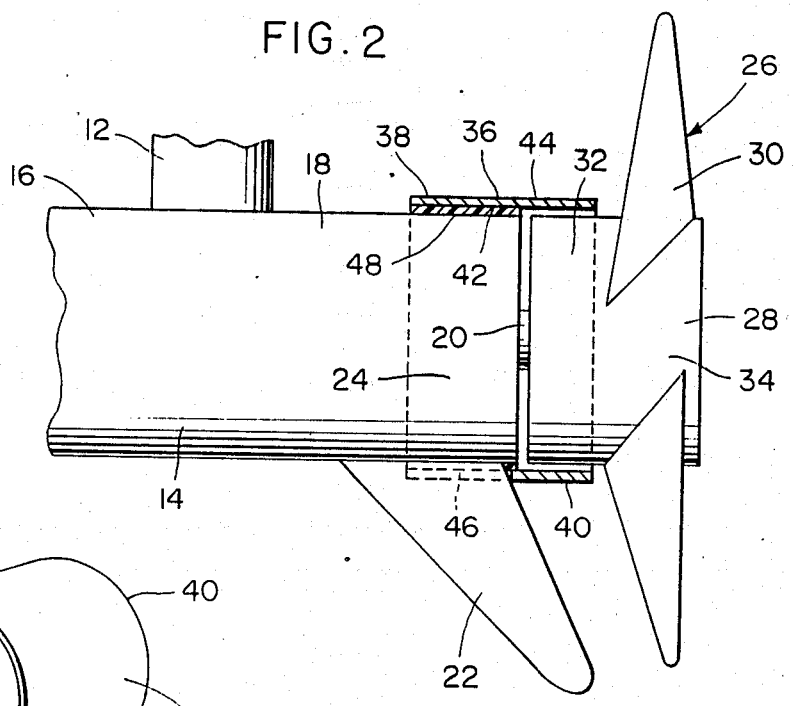
FIG. 2 is a fragmentary, enlarged, side elevational view of the assembly illustrated in FIG. 1 and with the protective sleeve and adhesive mounting layer therefor illustrated in vertical section and the lower skeg of the trolling motor being received through a forwardly opening longitudinal slot formed in the forward portion of the sleeve.
Figure 3:
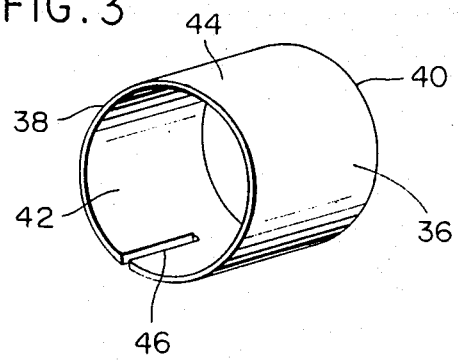
FIG. 3 is a perspective view of the protective sleeve illustrated in FIGS. 1 and 2.

Conventionally, the terminal end 24 and forward end 32 are of substantially the same outside diameter. However, as can be seen in FIG. 2, the forward end 32 usually is spaced slightly rearward of the rear terminal end 24. Further, the motor shaft is journalled from the housing portion 14 through the utilization of suitable bearings (not shown) and seal structure (not shown) stationarily mounted from the housing portion 14 is utilized to prevent the entrance of water into the rear end of the housing portion 14 about the one end 20 of the motor shaft.

Due to the axial spacing between the terminal end 24 and the forward end 32, seaweed strands, fishing lines and leaders and other small diameter line may enter the axial spacing between the terminal end 24 and the front end 32 and cause such material to be wound about the end 20 of the motor shaft. Such line or other material winding about the motor shaft end 20 can cause damage to the aforementioned seal means or other structure sealing the shaft end 20 to the housing portion 14 and allow water to enter the housing portion 14.

Accordingly, a need exists for structure by which elongated small diameter string-like members may be prevented from entering the axial spacing between the terminal end 24 and the front end 32.

In order to accomplish this function, the instant invention resides in the provision of a cylindrical sleeve 36 including first and second end portions 38 and 40. The sleeve 36 is of substantially cylindrical configuration and includes a constant diameter inner surface 42 and a substantially constant diameter outer surface 44. The sleeve 36 may be constructed of metal or plastic, and, in view of the skeg 22 on the housing portion 14, ,the end portion 38 of the sleeve 36 is provided with a longitudinally opening radial slot 46 in which to embracingly receive the rear portion of the skeg 22 when the sleeve 36 is mounted in operative position such as that illustrated in FIGS. 1 and 2.

The diameter of the inner surface 42 is slightly greater than the outside diameter of the rear terminal end 24 of the housing 14 and an adhesive band layer 48 is disposed over the outer surface of the rear end 18 of the housing portion 14 and the first end portion 38 of the sleeve 36 is disposed over the adhesive band layer 48 and adhered thereto.

The adhesive band layer 48 substantially occupies the radial spacing between the inner surfaces of the sleeve and said housing portion first end and may be a hardenable type of fluent adhesive applied to both the outer surface of the rear end 18 of the housing portion 14 and the inner surface 42 of the sleeve 36 before telescoping the first end portion 38 of the sleeve 36 over the terminal end 24 of the housing portion 14. Of course, before the sleeve 36 may be applied over the rear end 18 of the housing portion 14 the propeller 26 is removed.

If it is desired, the sleeve 36 may be constructed of spring material and include a full length radial slot rather than the one-half length radial slot 46. In such instance, a fully slotted sleeve may be slightly spread and thus more easily placed over the adhesive band layer.

In addition, means other than the adhesive band layer 48 may be utilized to secure the sleeve 36 in the position thereof illustrated in FIG. 2. Also, if the sleeve 36 is constructed of plastic, removal of the sleeve 36 may be more readily accomplished, inasmuch a plastic sleeve may be cut away from the adhesive band layer 48.

In operation, the second end portion 40 of the sleeve 36 is rearwardly overlap engaged with the front end 32 of the hub portion 28 to an extent which substantially eliminates any possibility of small diameter string-like material gaining access to the axial spacing between the terminal end 24 and the forward adjacent end 32 of the hub portion 28. Of course, the second or rear end portion 40 of the sleeve 36 loosely rotatably receives the front end 32 of the hub portion 28 therein.

It will of course be noted that not only electric trolling motors include axially opposing lower housing portion rear ends and propeller hub front ends disposed in closely axially spaced relation. The sleeve 36 also may be used on the lower unit of a conventional gasoline powered outboard motor or on the corresponding housing portion of the outdrive unit of an inboard/outboard drive assembly.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the, invention.

What is claimed as new is as follows:

1. In combination with an outdrive lower unit including a horizontally elongated front-to-rear extending housing portion including remote first and second ends, one end of a propeller shaft journalled from said housing portion projecting endwise outwardly from said first end, a propeller including a hub portion having opposite axial ends, said hub portion being removably mounted on said one end of said propeller shaft closely adjacent said first end, said first end and the adjacent axial end of said hub portion being at least substantially cylindrical and of substantially the same outside diameter, a protective sleeve having a substantially constant inside diameter slightly greater than the outside diameters of said first end and said adjacent end of said hub and including first and second end portions, said first end portion being mounted on said first end of said housing portion with said second end portion projecting outwardly of said housing portion first end and closely and loosely telescoped over said adjacent axial end of said hub portion, spanning and enclosing the axial spacing between said housing portion first end and said adjacent axial end of said propeller hub portion and closely rotatably receiving said propeller hub portion adjacent axial end therein said sleeve first end portion being mounted on said housing portion first end solely through the use of an adhesive band layer at least substantially occupying the radial spacing between the inner surface of said sleeve first end portion and said housing portion first end.

2. The lower unit and protective sleeve combination of claim 1 wherein at least the terminal end of said first end of said housing portion includes a peripherally continuous outer peripheral surface portion and the portion of said protective sleeve disposed thereover is peripherally continuous.

3. The combination of claim 2 wherein said housing portion includes a depending skeg portion spaced along said housing from said terminal end toward said second end, said first end portion being longitudinally slotted by a lengthwise extending generally radial slot formed therein, said skeg portion being snugly received in said slot.

4. In combination with an outdrive lower unit including a horizontally elongated and front-to-rear extending housing portion including remote first and second ends, one end of a propeller shaft journalled from said housing portion projecting endwise from said first end, a propeller including a hub portion having opposite axial ends, said hub portion being removably mounted on said one end of said propeller shaft closely adjacent said first end, said first end and the adjacent axial end of said hub portion being at least substantially cylindrical and of substantially the same diameter, the method of bridging the axial spacing between said first end of said housing portion and the adjacent axial end of said hub portion against the entrance of small diameter string-like material into the axial spacing between said first end of said housing portion and said adjacent axial end of said hub portion, said method including providing a generally cylindrical protective sleeve having an axial length considerably greater than the axial spacing between said first end of said housing portion and said adjacent axial end of said hub portion and with said sleeve having a substantially constant inside diameter slightly greater than the outside diameter of said first end of said housing portion and said adjacent end of said hub portion, and stationarily securing one end of said protective sleeve over said first end of said housing portion solely by the use of an adhesive band layer at least substantially occupying the radial spacing between the inner surface of said sleeve one end and said first end of said housing portion, and with said one end of said sleeve in telescoped engagement thereover and with the other end of said sleeve loosely telescoped over said adjacent end of said hub portion and loosely rotatably receiving said adjacent end of said propeller hub therein.

* * * * *